United States Patent [19]

Nishio

[11] Patent Number: 4,782,631

[45] Date of Patent: Nov. 8, 1988

[54] DOUBLE-END SURFACE GRINDING MACHINE

[75] Inventor: Kiyoshi Nishio, Toyonaka, Japan

[73] Assignee: Nissei Industry Corporation, Osaka, Japan

[21] Appl. No.: 11,909

[22] Filed: Feb. 5, 1987

[30] Foreign Application Priority Data

| | | | |
|---|---|---|---|
| Feb. 6, 1986 | [JP] | Japan | 61-16201[U] |
| Feb. 6, 1986 | [JP] | Japan | 61-16202[U] |
| Mar. 27, 1986 | [JP] | Japan | 61-69445 |
| Oct. 22, 1986 | [JP] | Japan | 61-162762[U] |

[51] Int. Cl.[4] ..... B24B 7/00

[52] U.S. Cl. ..... 51/111 R; 51/113; 51/118; 51/215 CP

[58] Field of Search ..... 51/111 R, 113, 109 R, 51/134.5 R, 215 AR, 118, 215 HN, 215 CP, 215 N; 356/138

[56] References Cited

U.S. PATENT DOCUMENTS

| | | | |
|---|---|---|---|
| 1,509,823 | 9/1924 | Blood | 51/111 R |
| 3,142,137 | 7/1964 | Fallon | 51/111 R |
| 3,541,734 | 11/1970 | Clar | 51/111 R |
| 3,653,160 | 4/1972 | Raickle | 51/111 R |
| 3,954,339 | 5/1976 | Atwood et al. | 356/138 |
| 4,462,187 | 7/1984 | Dunn | 51/111 R |

*Primary Examiner*—Frederick R. Schmidt
*Assistant Examiner*—Blynn Shideler
*Attorney, Agent, or Firm*—Armstrong, Nikaido, Marmelstein & Kobovcik

[57] ABSTRACT

A double-end surface grinding machine comprises a pair of rotating wheels disposed on a frame and opposing each other coaxially, and a carrier assembly for feeding a work in and out between two wheels and retaining the work during grinding, and a carrier frame supporting the carrier assembly is swivelable relative to the frame in a plane normal to the axis of rotation of the wheels.

2 Claims, 10 Drawing Sheets

DOUBLE-END SURFACE GRINDING MACHINE

BACKGROUND OF THE INVENTION

The present invention relates to a double-end surface grinding machine designed to feed a work between a pair of grinding wheels driven rotationally and to grind opposite surfaces of the work simultaneously with the two wheels.

A known double-end surface grinding machine is provided on a main frame with a pair of coaxially opposing sleeves which are axially movable by means of a suitable driving device via worms or the like, spindles driven rotationally by a motor through a belt transmitting device and being respectively supported freely rotationally within the sleeves, wheels mounted respectively on the adjoining ends of the spindles, with grinding surfaces opposing each other, and a carrier plate mounted on a carrier frame formed integrally on the front side of the main frame, and rotatable in a plane normal to the wheel axis in such a manner that its peripheral edge overlaps between the wheels, thereby to feed the work therebetween by the carrier plate to grind the opposite surfaces of the work simultaneously with the two wheels.

In the double-end surface grinding machine described above, replacement and dressing of the wheels, cleaning and maintenances of the machine may be performed entirely through windows opened on both sides of the main frame. However, since the windows provided on the sides of the main frame are generally smaller, there is such a disadvantage as that a working space would be limited. Thus, for example, when replacing the wheel which weighs about 50 to 80 kg, the limited working space through the window enforces a very dangerous work which was time consuming at the same time and resulted in a poor efficiency.

When grinding the work with the double-end surface grinding machine mentioned above, upper and lower edges of the work must be projected from both surfaces of the carrier plate by forming the thickness of the carrier plate thinner than that of the work, and in order to grind the work precisely in this state, it is desirable to make the upper and lower projections of the work even. Thus, when the thickness of the work is changed, its projection must be adjusted to become even. In the past, in such case, a spacer for adjusting the projection was interposed between the carrier plate and a mounting board onto which the carrier plate is mounted, and replaced to adjust the upper and lower projections of the work. However, since the carrier plate must be removed from the mounting board to replace the spacer, replacement is extremely complicated and annoying.

In some of the double-end surface grinding machines, a rotating motion is given to the work to improve its grinding efficiency. That is, on the carrier frame, in place of the carrier plate, a swivel arm oscillating and swinging within a range of prescribed angle in a plane normal to the wheel axis, is disposed in such a manner that is periphery overlaps partially between the wheels, on the swivel arm a work pocket gear retaining the work eccentrically is supported freely rotationally, said work pocket gear being coupled via suitable transmitting means to a driving motor, which rotates the work pocket gear to provide the rotating motion to the work. In this case, if the thickness of the work being ground is thinner, the thickness of the swivel arm becomes thinner accordingly and the work pocket gear can be hardly supported through a bearing or the like from the dimensional point of view. Therefore, the work pocket gear is supported by a rotating support provided at one portion thereof and placed on the swivel arm. However, since the work pocket gear makes a sliding rotation with respect to the swivel arm, a contact between the work pocket gear and swivel arm tends to wear soon. In particular, wheel powders, grinding chips or the like entering the contact between the work pocket gear and swivel arm at grinding accelerate such wear. As the wear grows larger, a jolt of the contact increases to deteriorate the interlocking of gears, thereby the rotation becomes irregular or stops to cause a poor grinding accuracy. Therefore, a hardened steel or a hard metal are used for the contact hitherto, which is so far ineffective.

In the double-end surface grinding machine, in order to provide a cutting allowance to the work, a grinding condition is set to tilt the axis of the upper wheel with respect to that of the lower wheel to bring the distance between the grinding surfaces of the wheels in such a manner that, the take out position of the work is narrower than the feeding position by the cutting allowance. As means to tilt the axis of upper wheel relative to that of the lower wheel in such a way, in the past, the main frame is divided into upper and lower portions, whereby the upper portion supporting an upper quill if the upper wheel is brought to tilt optionally with respect to the lower portion supporting a lower quill of the lower wheel to enable the upper wheel axis to tilt optionally relative to the lower wheel axis, but the tilting of the upper portion is extremely troublesome and time consuming. Besides,. since the upper wheel axis is tilted by tilting the upper frame, the main frame must be divided, thus strength of the main frame is deteriorated. Accordingly, when the moment is resisted by the frame due to a grinding reaction force applied on the wheels by the grinding resistance, the grinding surfaces of the wheel tend to tilt during grinding, so that the dimensional tolerances can not be maintained accurately for the precise machining.

Now, in the-double-end surface grinding machine, if the wheels are used for a long period of time or its grinding condition is inadequate, the grinding surfaces of the wheels are crushed and stuffed to deteriorate the grinding performance and to raise the heat value, thereby causing cracks and fusions on the finished surfaces.

Therefore, when the grinding surfaces of the wheels are crushed or stuffed, worn particles on the upper layer of grinding surfaces and chips stuffed between such particles or pores must be removed, and the grinding surfaces must be dressed to expose new particles thereon.

Normally a dresser is utilized for dressing. The dresser is formed by projecting diamond tools on the upper and lower tips of a dress-arm which is disposed on the main frame so as to be driven swingingly within a plane normal to the wheel axis by a dress-arm driving motor, by driving the dress arm swingingly and inserting the diamond tools between the rotating wheels to move radially of the wheels, worn grinding particles on the upper layer of the grinding surfaces or stuffed chips on the wheels are shaved off, and the new grinding particles may be exposed on the grinding surfaces of the wheels.

In dressing using the dresser, since revolution of the wheels is constant, different circumferential speeds occur on the grinding surfaces of the wheels, thus the collision speeds between the grinding particles of the wheels and the diamond tools of the dresser differ from each other causing uneven dressing of the entire grinding surfaces and insufficient accuracy regardless of the dressing. For example, the shape which is otherwise a plane normal to the wheel axis after the dressing, becomes inclined against the plane normal to the wheel axis. This is because, as the diamond tools proceed diametrically inside the grinding surfaces, the grinding particles of the wheels are shaved off more than necessary by the dressing resistance applied thereon, since the circumferential speed of the grinding surfaces of the wheels is slow.

SUMMARY OF THE INVENTION

According to one embodiment of the present invention, a double-end surface grinding machine comprises a main frame provided with two coaxially opposing grinding wheels, a carrier assembly rotating a carrier plate retaining a work to feed the work between the two wheels on the main frame, and a carrier frame having the carrier assembly mounted thereon, the carrier frame being mounted on the main frame for rotation about a point on or off the main frame in a plane normal to the wheel axis. The carrier plate may be supported movably vertically. Therefore, the carrier frame on the front side of the main frame can be rotated or shifted in a plane normal to the wheel axis and projection of the work from the carrier plate may be adjusted by moving the carrier plate vertically.

According to another embodiment of the present invention, a double-end surface grinding machine comprises a main frame provided with two coaxially opposing grinding wheels, a carrier assembly having means for swinging a swivel arm retaining a work to feed the work between two wheels on the main frame, means for rotating a work pocket gear retaining the work at the swivel arm to give a rotating motion to the work, and means for reciprocating a block provided with the swivel arm to give an oscillating motion to the work, and a carrier frame having the carrier assembly mounted thereon, the carrier frame being mounted on the main frame for rotation about a point on or off the main frame in a plane normal to the wheel axis. Moreover, a wear-proof material may be provided on the rotating contact surfaces of the work pocket gear and the swivel arm and at least a surface of the wear-proof material may consist of fine ceramics of oxide, nitride, or carbide group. Therefore, the carrier frame on the front side of the main frame can be rotated or shifted in a plane normal to the wheel axis, and the wear resistance of the rotating contact surfaces of the work pocket gear and the swivel arm may be improved.

According to a further embodiment of the present invention, a double-end surface grinding machine comprises a pair of opposing wheel heads mounted on a frame, and adapted to feed a work therebetween to simultaneously grind opposite sides of the work with the two wheels, one of the wheel heads requiring the adjustment of tilt being constructed by a spindle rotating the wheels mounted at one end, a quill supporting the spindle freely rotationally, a sleeve holding the quill and supported on the frame freely swivelably by a swivel mechanism, an adjusting mechanism for freely swivelling said sleeve relative to the frame to optionally adjust the tilt, a clamp mechanism for fixing the sleeve on the frame, a sensor for electrically detecting the tilt of the wheel and provided rotationally on the spindle, and an annual zero guide arranged on the opposite side of the sensor on the frame after centering. Thereby the tilt of the wheel can be adjusted optionally and detected and indicated by the sensor by swivelling the sleeve freely relative to the frame.

According to a still further embodiment of the present invention, a dresser of a double-end surface grinding machine for dressing the grinding surfaces of the wheels by inserting diamond tools with a dress arm between the rotating wheels to move radially thereof, comprises a wheel revolution sensor for detecting the number of wheel revolution and a dress arm position (angle) sensor for detecting the dress arm position (angle), thereby to respectively detect the wheel revolution and the dress arm position (angle) for the dressing wheel diameter to be detected by the diamond tools, so that the wheel circumferential speed is computed through these detected values and fed back to a wheel driving motor to bring the circumferential speed constant. Therefore, regardless of the circumferential speed difference of the inner and outer wheel diameters, the dressing operation can be performed always under the constant circumferential speed.

The above and other objects and features of the present invention will become more apparent from the following description in connection with the accompanying drawings illustrating the preferred embodiment of the present invention, in which like reference numerals designate, in effect, like members and parts throughout all drawings for purposes of convenience, and in which;

FIG. 1 through FIG. 3 show schematic external views of a double-end surface grinding machine, wherein FIG. 1 is a front view, FIG. 2 is a side view and FIG. 3 is a plan view;

DESCRIPTION OF THE PREFERRED EMBODIMENT

Figure 2:
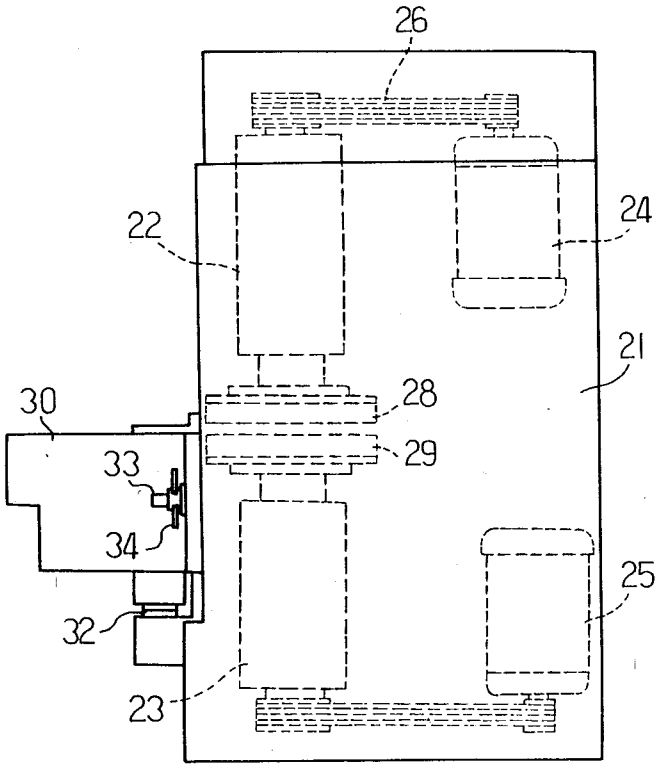
Figure 1:
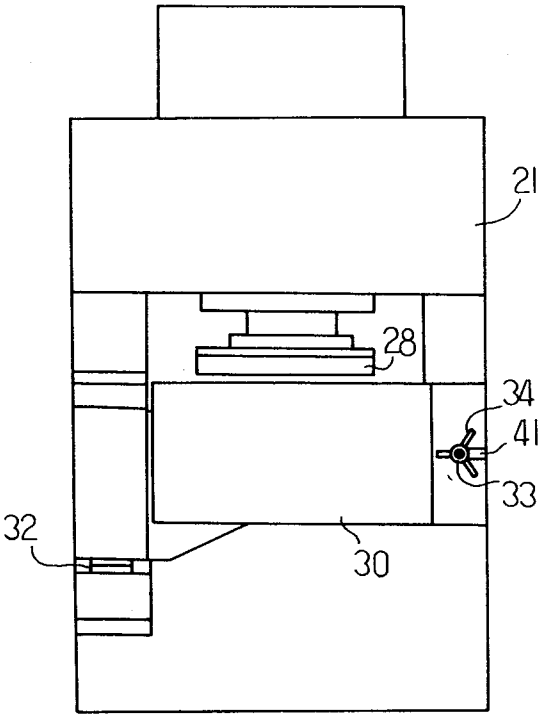
Figure 4:
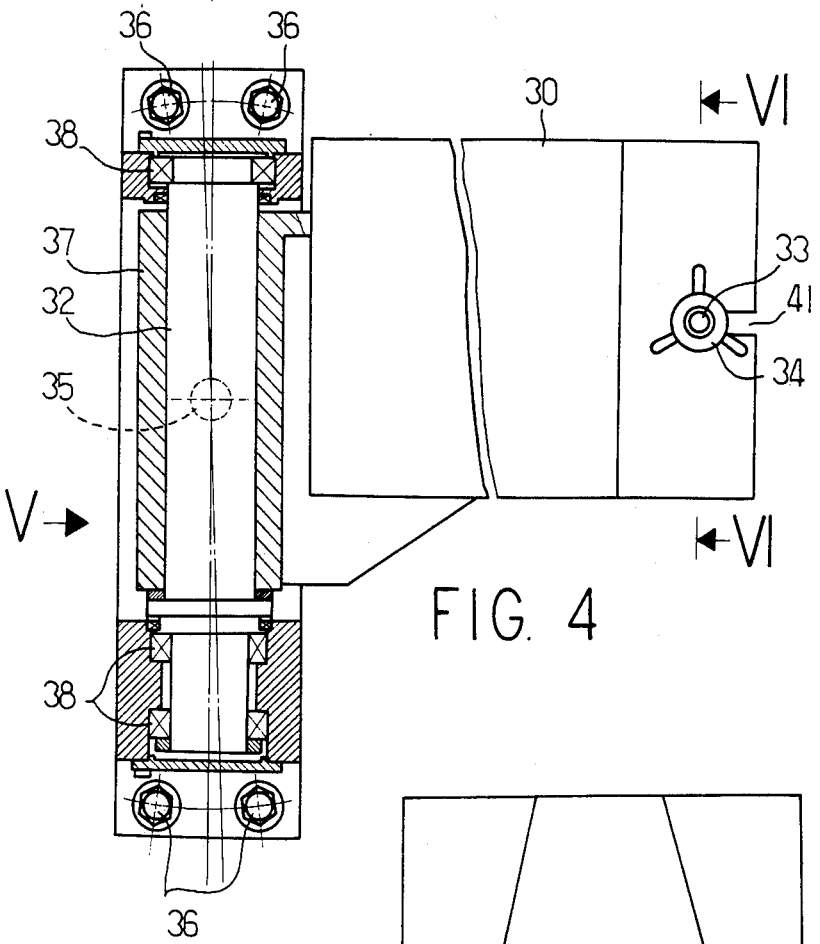
FIG. 4 is a partly sectional enlarged view of a carrier frame of FIG. 1.
Figure 3:
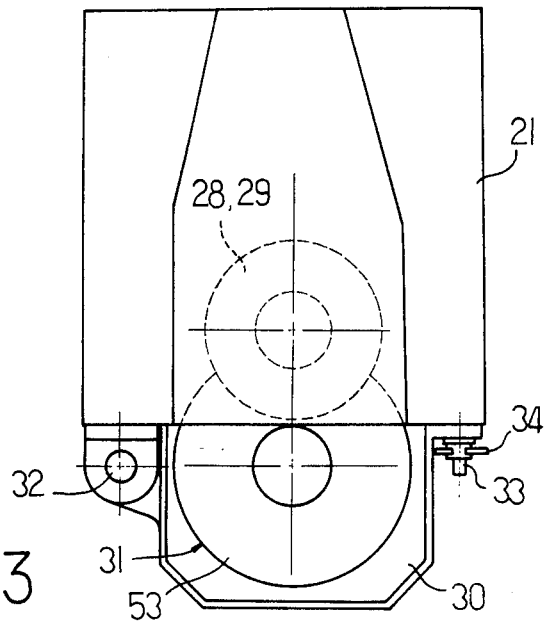
Figure 5:
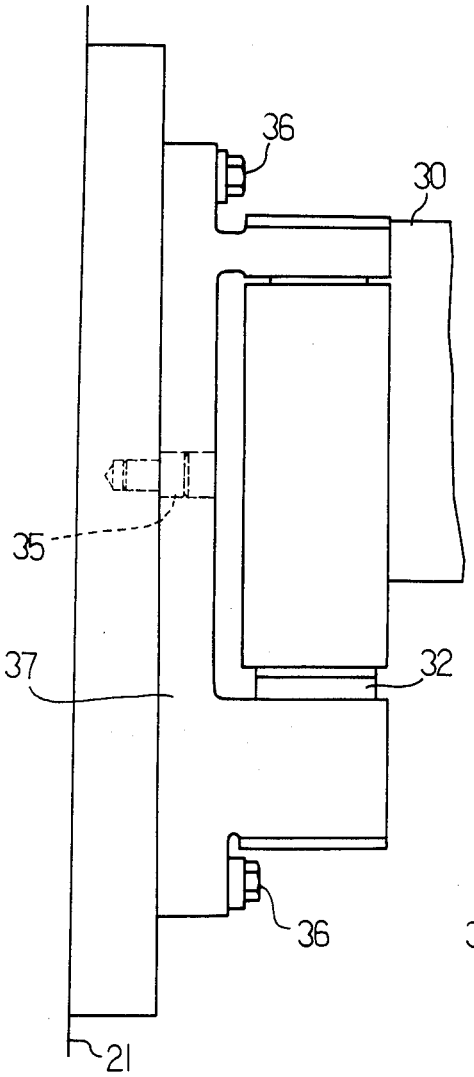
FIG. 5 is a view of a carrier frame of FIG. 4 taken in the direction of the arrow V.
Figure 6:
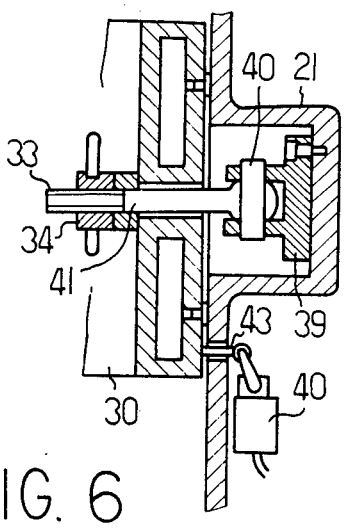
FIG. 6 is a sectional view of a carrier frame taken along the line VI—VI of FIG. 4.

In FIG. 1 through FIG. 3, the numeral (21) indicates a main frame provided with a pair of sleeves (22) (23) which are movable vertically with a suitable driving device (not shown) via a worm or the like on a coaxial line on opposite sides, within the two sleeves (22)(23) spindles (not shown) rotationally driven with motors (24)(25) via belt transmitting units (26)(27) are respectively supported freely rotationally, and on corresponding shaft ends of the two spindles, wheels (28)(29) are respectively mounted with its grinding surface opposing each other. The numeral (30) denotes a carrier frame mounted on the front side of the main frame (21) and provided with a carrier assembly (31) which feeds a work between the two wheels (28)(29). The carrier frame (30) is pivotably connected to the main frame (21) at one end through an opening and closing rotary shaft (32), and fixed to the main frame (21) at the other end through a hinge bolt (33) and a clamping handle (34), and adapted to be open and closed relative to the main frame (21) about the opening and closing rotary shaft (32) by releasing the other end fixed by the hinge bolt (33) and clamping handle (34). The opening and closing rotary shaft (32) is, as shown in FIG. 4 and FIG. 5, pivotably connected to the main frame (21) swingingly about a pint (35), and usually supported by a base (37) fixed to the main frame (21) via a bearing (38) freely rotationally. The hinge bolt (33) is, as shown in FIG. 6, also pivotably connected to a bracket (39) fixed to the main frame (21) via a pin (40), and inserted into a notch (41) provided on the other end of the carrier frame (30) to fix it to the main frame (21) by tightening the clamping handle (34) screwed to the tip portion thereof. In FIG. 6, the numeral (42) indicates a safety switch disposed within the main frame (21) for checking the closed, state, and actuated by a projection rod (43) projected on the other end of the carrier frame (30) when the carrier frame (30) has been surely closed relative to the main frame (21).

Figure 7:
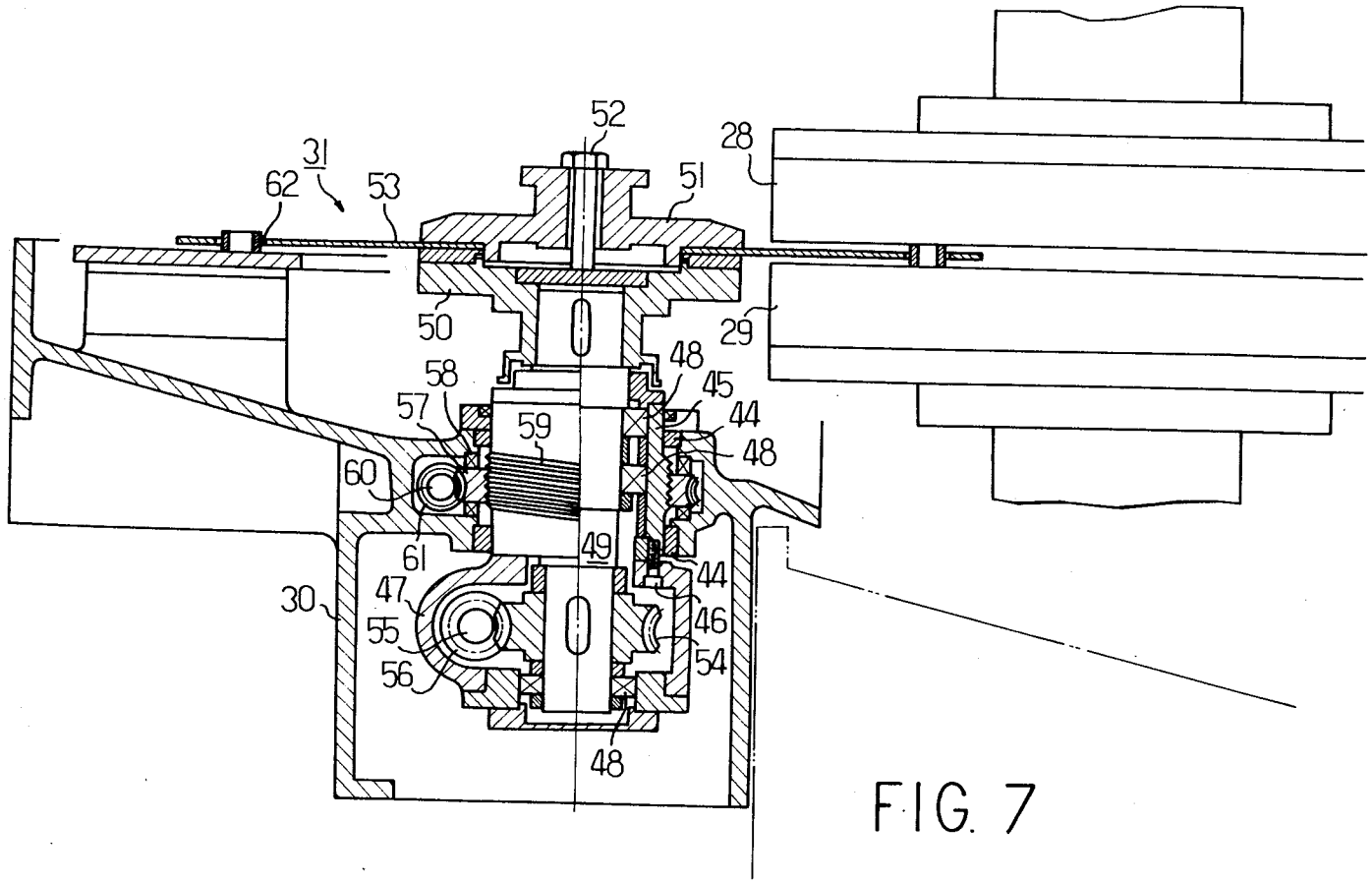
FIG. 7 is a partly enlarged sectional view of a carrier assembly of FIG. 2.
Figure 8:
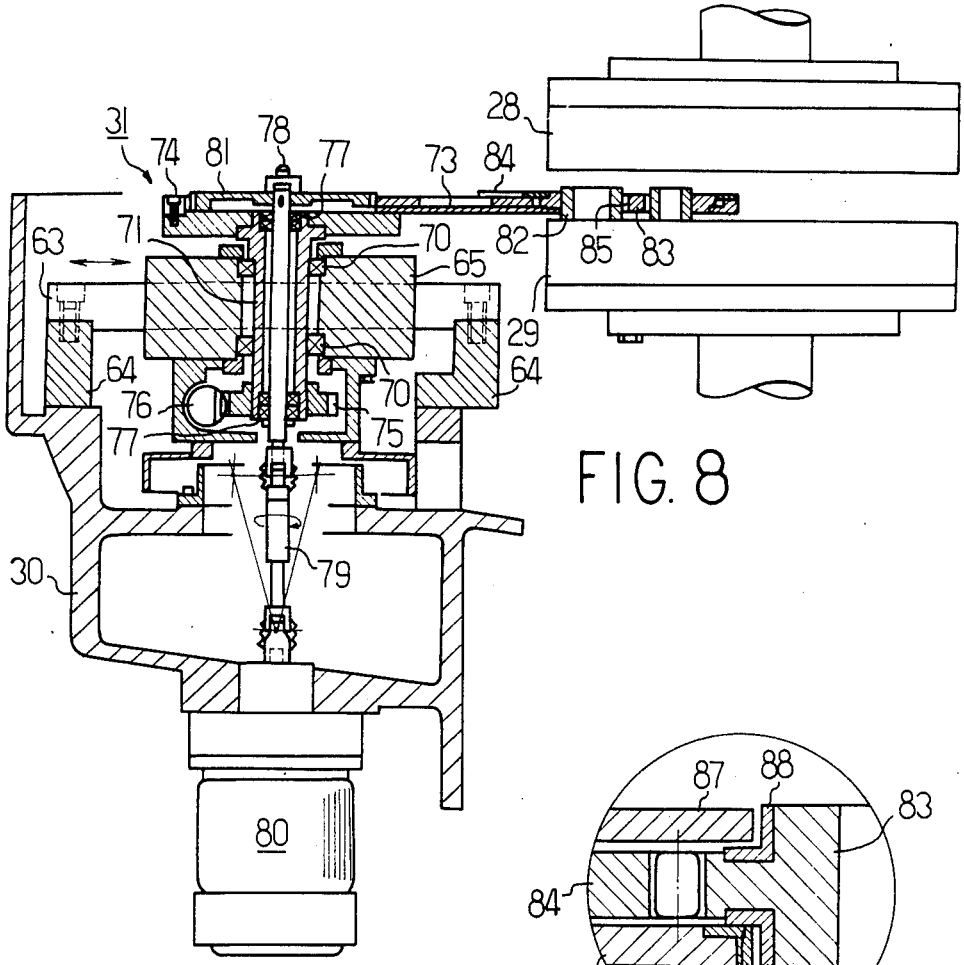
FIG. 8 is a view similar to FIG. 7, but showing a modified embodiment of a carrier assembly.
Figure 10B:
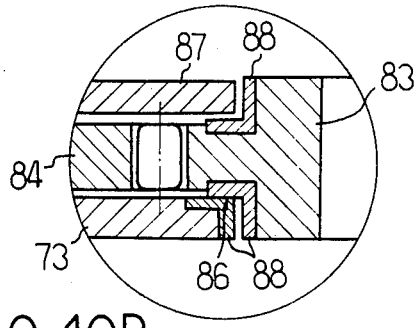
FIG. 10B is a further enlarged view of a B portion of FIG. 10A.
Figure 10A:
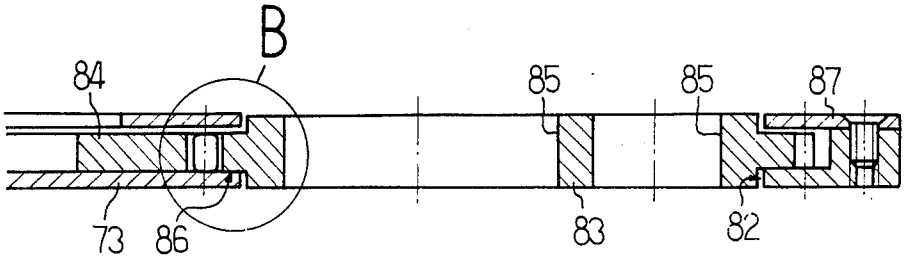
FIG. 10A is an enlarged view of a work pocket gear of FIG. 8.
Figure 9:
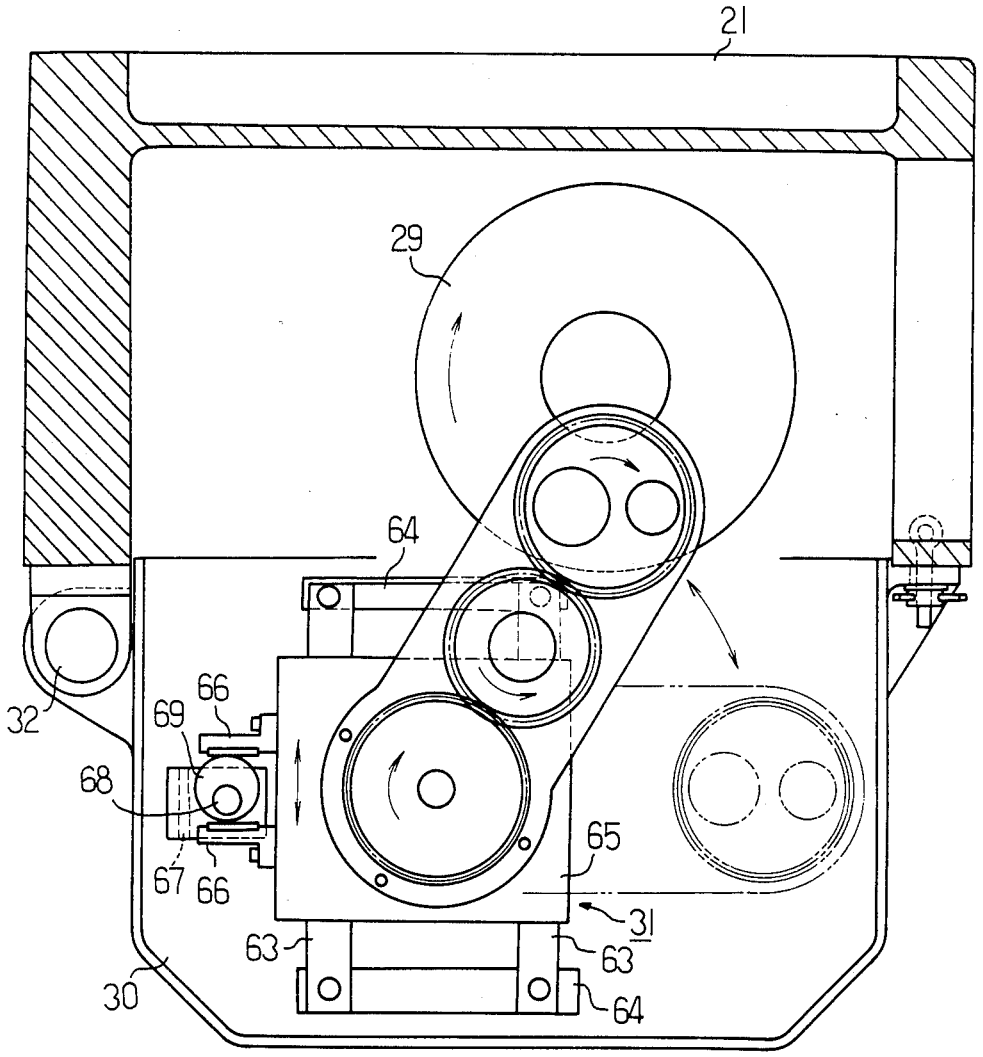
FIG. 9 is a plan view of a carrier assembly of FIG. 8.

Now, in the carrier assembly (31), as is shown in fig. 7, a sleeve (45) is supported on the carrier frame (30) movably vertically via a sliding metal (44), on the lower end of the sleeve (45) a casing (47) is secured via a clamping bolt (46), a carrier plate shaft (49) is born freely rotationally within the sleeve (45) and casing (47) via a bearing (48), on a carrier plate mounting board (50) fixed integrally on the upper end of the carrier plate shaft (49), a carrier plate (53) is secured via a carrier plate biasing member (51) and a clamping bolt (52), a worm wheel (54) integrally fixed to the lower end of the carrier frame shaft (49) is mated with a worm bear (56) formed integrally with a worm shaft (55) coupled to a driving motor (not shown), on the carrier frame (30) a worm wheel (57) is supported axially stationarily but freely rotationally via a bearing (58), the worm wheel (57) is screwed to a screw portion (59) threaded on the outer circumference of the sleeve (45) and mated with a worm gear (61) formed integrally with a worm shaft (60) coupled to a height adjusting handle (not shown) etc. The carrier plate (53) is designed to feed the work directly between the two wheels (28)(29) and formed in a disc shape, whereon a plurality of work retaining holes (62) for containing the work are provided at an equal distance circumferentially.

Now, in the carrier assembly (31) constructed as aforementioned, when the driving motor is driven to rotate the worm shaft (55), the carrier plate shaft (49) is rotated via the worm gear (56) and worm wheel (54), thereby the carrier plate (53) is rotated to feed the work contained in the work retaining the hole (62). By the continuous feeding operation, the work is fed between the two wheels (28)(29), which grind both surfaces of the work simultaneously.

Next, when the worm shaft (60) is rotated by the height adjusting handle, the worm wheel (57) is rotated via the worm gear (61) and the sleeve (45) is moved up or down due to the mating relationship between the worm wheel (57) and the screw portion (59) of the sleeve (45), thereby the carrier plate shaft (49) supported by the sleeve (45) is moved up and down to move the carrier plate (53) up or down. As mentioned above, even when the thickness of the work is changed, by moving the carrier plate (53) vertically, projection of the work from both surfaces of the carrier plate (53) may be made equal. As such, since the carrier frame is arranged to open and close in a direction normal to the wheel axis in front of the main frame, a working space is not limited and replacement and dressing of the wheels and cleaning and maintenance of the machine can be performed extremely easily. In particular, when replacing the wheel which weights about 50 to 80 kg., a forklift and the like can be utilized, improving the working performance and safety considerably. Moreover, since the carrier plate can be moved vertically simply with the hand and the like, when the work thickness is changed and the upper and lower projections of the work should be made equal, the adjustment can be performed very simply and effectively, besides since the revolution is reduced by the worm, a fine adjustment is possible and the upper and lower adjustment may be made equally with good accuracy, improving the grinding accuracy.

Now, referring to FIG. 8, FIG. 9, FIG. 10A and FIG. 10B showing a modified embodiment of the carrier assembly, on the carrier frame (30) a pair of guiding rods (63) are arranged in parallel and supported fixedly on brackets (64) at the opposite ends, on the pair of guiding rods (63) a bearing block (65) is supported freely slidably, on one side of the bearing block (65) a pair of receiving members (66) are secured, between which an oscillating eccentric arm (69) secured to an output shaft (68) of an oscillating driving motor (67) secured to a portion of the carrier frame (30) is provided. On the bearing block (65) a cylindrical carrier shaft (71) is supported freely rotationally via a bearing (70), on a swivel arm mounting board (72) fixed integrally to the upper end of the carrier (71), a swivel arm (73) is secured via a fixing bolt (74), and a rack (76) coupled to an arm swiveling cylinder (not shown) is mated with a carrier gear (75) secured integrally to the lower end of the carrier shaft (71). Moreover, within the carrier shaft (71) a driving shaft (78) is disposed freely rotationally via a bearing (77), to the lower end of the driving shaft (78) a work rotating motor (80) is coupled via an universal joint (79), and on the upper end thereof a driving gear (81) is secured integrally, to which a work pocket gear (83) retained freely rotationally within a gear retaining circular hole (82) on the tip of the swivel arm (72) is engaged via an intermediate gear (84). The work pocket gear (83) is, as shown in FIG. 1OA and FIG. 1OB, formed with a work pocket (85) containing the work and a rotation supporting surface (86) on the periphery, which is retained by the upper surface of the swivel arm (73) around the gear retaining circular hole (82) and the lower surface of a work pocket gear guide (87) secured to the swivel arm (73) and supported freely rotationally thereby. On the rotating contacts between the work pocket gear (83) and the swivel arm (73) and the work pocket gear guide (87), that is, on the rotation supporting surface (85) of the work pocket (83) and around the gear retaining circular hole (82) of the swivel arm (73), a wear-proof material (88) consisting of a fine ceramics of oxide, nitride and carbide groups are provided.

Now, in the carrier assembly (31) constructed as aforementioned, when the arm swiveling cylinder is driven to rotate the carrier shaft (71) by the rack (76) via the carrier gear (75), the swivel arm (73) is rotated by a prescribed angle via the swivel arm mounting board (72), thereby the work contained within the work pocket (85) of the work pocket gear (83) is fed between the two wheels (28) (29) which grind the both sides of the work simultaneously.

At this time, when the oscillating driving motor (67) is driven to rotate the oscillating eccentric cum (69), the bearing block (65) reciprocates horizontally along a pair of guiding rods (63), thereby the swivel arm (73) is reciprocated via the carrier shaft (71) supported on the bearing block (65) to reciprocate the work pocket gear (83), and to give the oscillating motion to the work contained in the work pocket (85) of the work pocket gear (83). Simultaneously, when the work rotating motor (80) is driven to rotate the driving shaft (78) via the universal joint (79), the work pocket gear (83) is rotated via the driving gear (81) and the intermediate gear (84) to give a rotating motion to the work contained within the work pocket (85) of the work pocket gear (83).

As mentioned above, the grinding operation of both surfaces of the work is effected by the oscillation motion of the work in a direction normal to the wheel axis, and the rotating motion of the work and the wheels (28)(29), thereby a grinding volume is increased and a highly precise and efficient grinding operation is possible.

In the modified carrier assembly, since the carrier frame is designed to open and close in a direction normal to the wheel axis in front of the main frame, the working space is not limited, replacement and dressing of the wheels, cleaning and maintenance of the machine can be performed extremely easily. In particular, when replacing the wheel which weights about 50 to 80 kg., a forklift and the like may be utilized, improving the working performance and safety considerably. Moreover, since the wear-proof material having the surface consisting, at least, of a fine ceramics of oxide, nitride and carbide groups is provided on the rotating contact between the work pocket gear and the swivel arm which is brought into contact as the work pocket gear rotates, wear of the rotating surface may be improved resulted in a smooth rotation and a high grinding accuracy.

Figure 11:
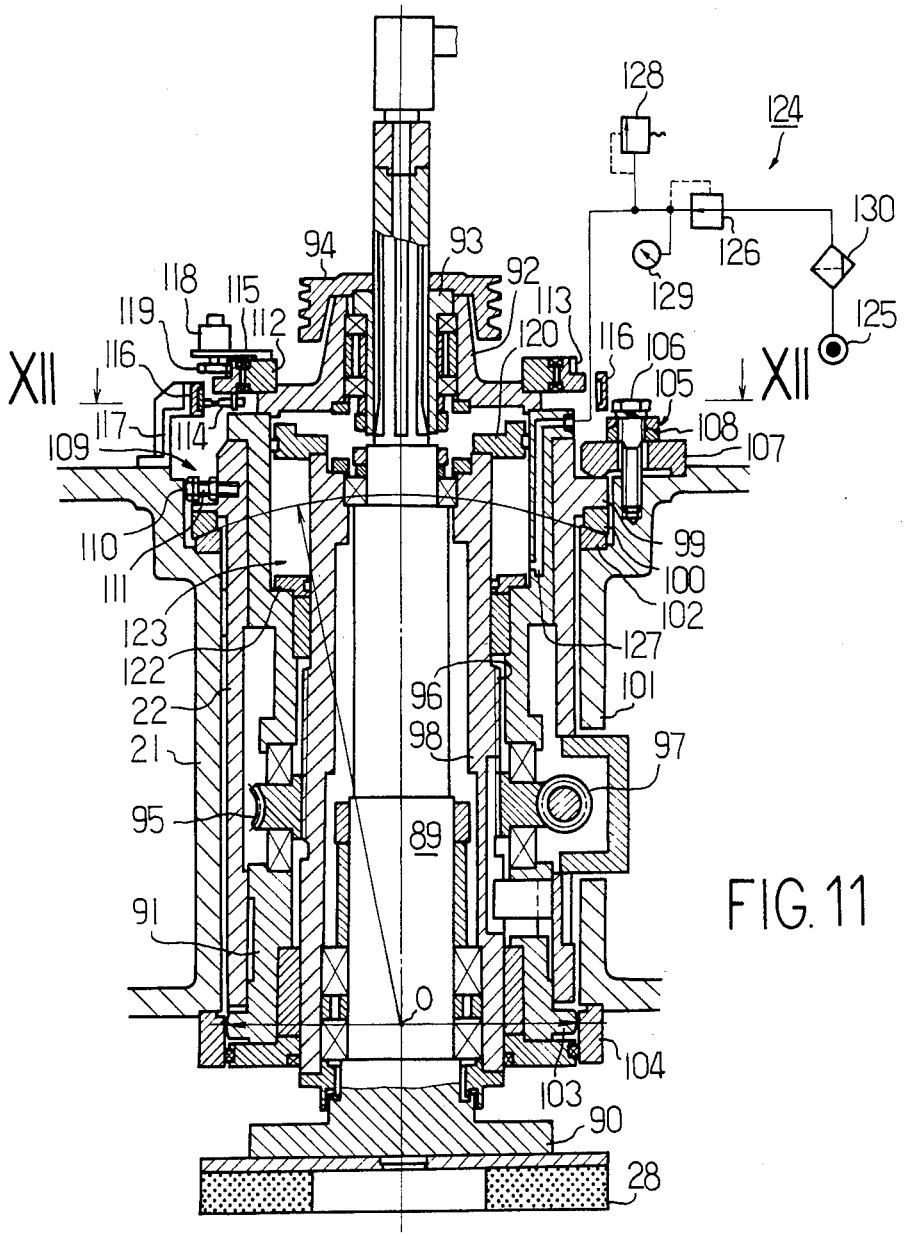
FIG. 11 is a longitudinal sectional view of an upper wheel head.
Figure 12:
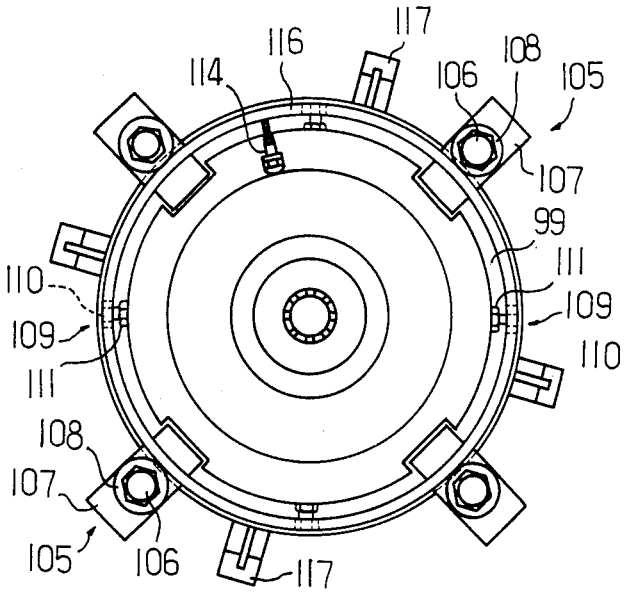
FIG. 12 is a view taken along the line XII—XII of FIG. 11.

FIG. 11 and FIG. 12 show another embodiment of a double-end surface grinding machine, in which the numeral (28) denotes an upper wheel disposed on the coaxial line on the opposite side of a lower wheel (not shown), and secured on a wheel receiving plate (90) formed integrally on the lower end of a spindle (89) supported freely rotationally within an upper quill (98) disposed movably vertically relative to the frame (21). The numeral (91) indicates a inner sleeve supporting the upper quill (98) freely rotationally vertically and secured with a cap (92) on the upper end. The numeral (93) denotes a rotary cylinder supported freely rotationally on the cap (92) and in spline engagement with the upper portion of the spindle (89) and secured integrally with a driven pulley (94). The driven pulley (94) is coupled via the belt and driving pulley (26) to the motor secured integrally on the frame (21) (FIG. 2), which rotates the rotary cylinder (93) via the driving pulley, belt and driven pulley (94) to rotate the spindle (89) engaged with the rotary cylinder (93) and the upper wheel (28).

The numeral (95) indicates a worm wheel engaged to the screw portion (96) threaded on the intermediate outer circumference of the upper quill (98) and supported on the inner sleeve (91) freely rotationally but not movably axially. The numeral (97) is a worm engaging continuously with the worm wheel (95) and supported on the frame (21) freely rotationally by suitable means and coupled to a driving device (not shown). When it is rotated by the driving device, the worm wheel (95) engaged continuously therewith is rotated, and by the engagement between the worm wheel (95) and the screw portion of the upper quill (98), the latter is moved vertically relative to the inner sleeve (91), resulting in the upper wheel (28) being moved vertically via the spindle (89) supported on the upper quill (98).

The numeral (22) denotes an outer sleeve retaining the inner sleeve (91) integrally and supported on the frame (21) so as to be freely swivelable by a swivel structure. That is, a movable ring (100) secured on a collar (99) projecting on the upper outer circumference of the outer sleeve (22), and having a spherical lower sliding surface having the center of curvature at point (0) on the axis of the spindle (89), is placed on a fixed ring (102) secured on a shoulder portion (101) formed on the upper portion of the frame (21)and having a spherical upper sliding surface having the center of curvature at point (0) to support the upper portion of the outer sleeve (22), while a lower collar (103) of the inner sleeve (91) retaining the lower portion of the outer sleeve (22), and having a spherical outer sliding circumference having the center of curvature at point (0), is engaged inside a cylinder (104) secured to the lower end of the frame (21) to support the lower portion of the outer sleeve (22) on the frame (21). Usually the outer sleeve is fixed integrally to the frame (21) by means of a plurality of clamping mechanisms (105) arranged circumferentially at regular intervals on the upper portion of the frame (21). The clamping mechanism (105) is formed by mounting a clamper (107) on the upper end of the frame (21) with clamping bolt (108) via an alignable washer (108), so that by tightening the clamping bolt (108), the upper collar (99) of the outer sleeve (22) is biased and clamped by the clamper (107) to fix the outer sleeve (22) to the frame (22).

The numeral (109) indicates an adjusting mechanism for adjusting the tilt of the upper wheel axis (28), which includes a plurality of adjusting bolts (110) arranged at regular intervals on the upper outer circumference of the outer sleeve (22), so that by tightening and loosening each adjusting bolt (110) optionally, the tilt of the upper wheel axis (28) is adjusted. That is, after loosening the clamping bolt (106) of the clamping mechanism (105) to release the outer sleeve (22) from the frame (21), and in the state where gaps are formed between its head portion and the inner circumference of the frame (21) by tightening, for example, one or two adjusting bolts (110), when the remained adjusting bolts (110) are loosened to bias the inner circumference of the frame (21) to its head portion so as to remove all the gaps, the outer sleeve (22) is swivelled about point (0) on the axis line of the spindle (89), thereby the inner sleeve (91), upper guill (88) and spindle (89) are swiveled to tilt the upper wheel axis (28). When the tilt of the upper wheel axis (28) is adjusted and the prescribed tilt is obtained by the aforementioned operation, the adjusting bolts (110) are fixed by lock nuts (111) and the outer sleeve (22) is fixed to the frame (21) by the clamping bolt (106) of the clamping mechanism (105) to complete adjustments.

Figure 15:
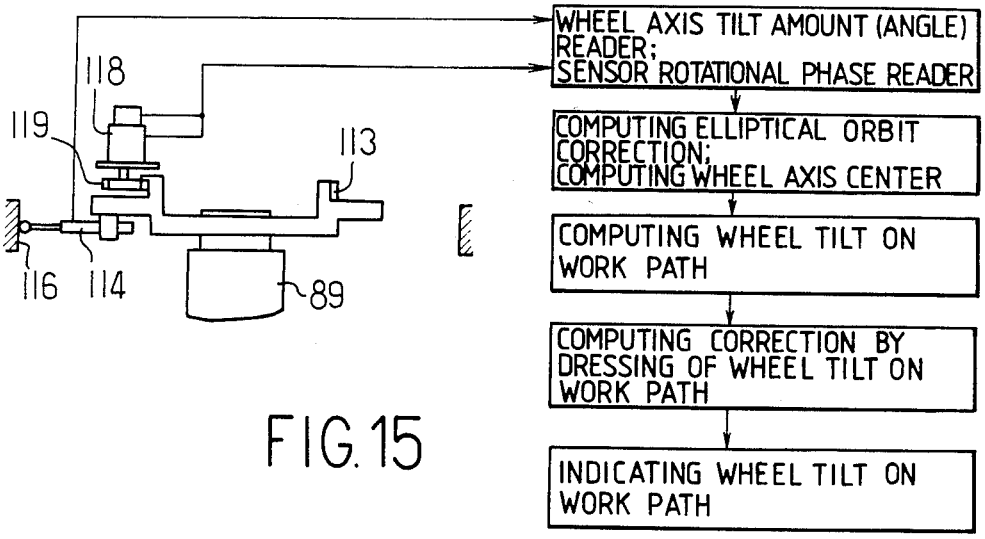
FIG. 15 is a pattern diagram showing the principle of a device which electrically detects and indicates a tilt of a wheel.
Figure 13:
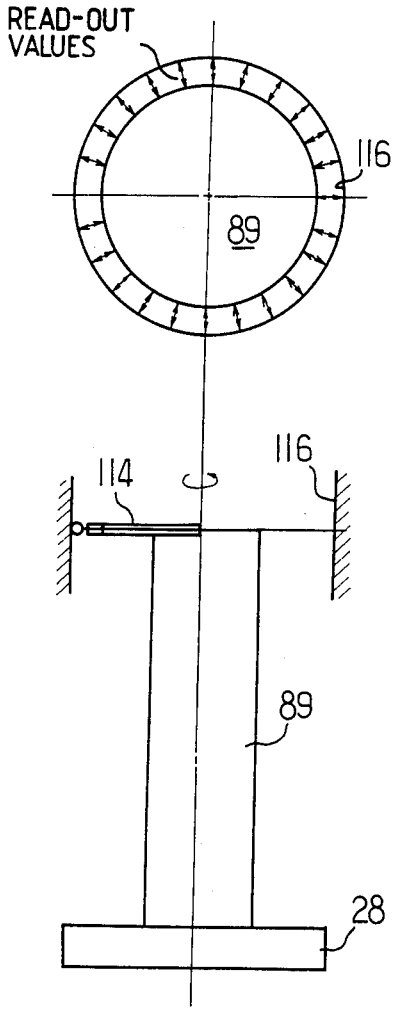
FIG. 13 and FIG. 14 are patterns of an upper wheel head, but respectively showing the states where a wheel axis is tilted and not tilted.
Figure 14:
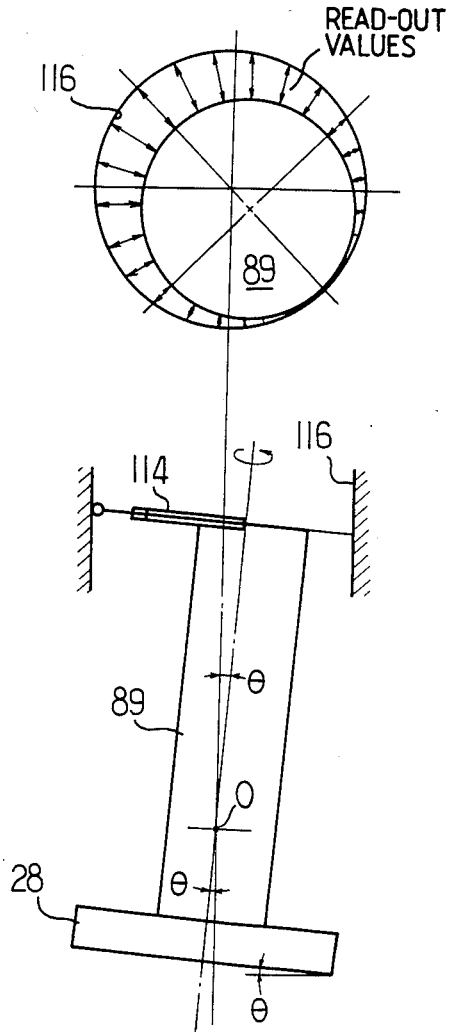

The numeral (112) denotes a fixed base secured to a cap (92) and integrally formed with a gear (113) at the upper portion, and rotatively supporting a sensor rotating support (115) which in turn carries a tilt reading sensor (114) at the lower portion. The numeral (116) denotes a zero guide for the wheel axis tilt disposed in such a manner that an actuator of the sensor (114) is contacted continuously thereto, and secured to the frame (21) coaxially with its inner circumference via a plurality of brackets (117). The numeral (118) indicates a sensor rotating motor secured to the fixed base (112) via an arm, and continuously engaged to the gear (113) of the sensor rotating support (115) at a gear (119) secured to its output shaft. When the motor (118) is rotated, the sensor rotating support (115) is rotated via the gears (119) (113), and the tilt reading sensor (114) is rotated synchronously, thus allowing the tilt of the upper wheel (28) to be detected and indicated. That is, as is shown in FIG. 13, when the upper wheel axis is not tilted relative to the frame (21), the sensor (114) is rotated coaxially against the frame (21) so that a read value of the sensor (114) is not changed, but for example, as is shown in FIG. 14, when the upper wheel axis is tilted relative to the frame (21), the sensor (114) is rotated eccentrically against the frame (21) so that a read value of the sensor (114) is changed, which is electrically processed to detect and indicate the tilt of the upper wheel axis as shown in FIG. 15.

The numeral (120) denotes a piston secured to the upper end of the upper guill (98) and contained within a cylinder chamber (123) formed by the upper inner circumference of the inner sleeve (91), cap (92) and a cover (122), and biased upwardly at any time by compressed oil or air working inside the cylinder chamber (123) to pull the upper quill (98) upwardly, thereby pulling the upper wheel (28) upwardly via the spindle (89) supported on the upper quill (98), and continuously biasing one inclined surface side of the thread of the screw portion (98) threaded on the intermediate outer circumference of the upper quill (98), against one inclined surface side of the thread of the mating portion of the worm wheel (95) opposing the inclined surface side aforementioned to solve deterioration of the grinding accuracy due to the backlash in the mating portion. The numeral (124) indicates a hydraulic or pneumatic circuit for supplying the cylinder chamber (123) with compressed oil or air via a conduct (127) provided in the inner sleeve (91), regulating the hydraulic or pneumatic pressure in a hydraulic source (125) at a constant by a reducing valve (126). A safety wheel may valve, pressure gauge and filter is indicated respectively at (128), (129) and (130).

In the embodiment, since the quill supporting the upper wheel is designed to be supported on the frame via the swivel structure, and swiveled freely by the adjusting mechanism to adjust the tilt of the upper wheel optionally and fix to the frame by the clamping mechanism, the tilt of the upper wheel can be simple adjusted, and thus the time and trouble required thereby can be considerably reduced. Moreover, since the frame is not needed to be divided as in the past, it may be constructed so rigidly that a dimensional tolerance can be maintained during the grinding operation, and is very efficacious that it can be practically applicable for the precise grinding. Furthermore, since the sensor for reading the wheel tilt is provided rotationally on the upper wheel head, and the centered zero guide is mounted on the frame, the tilt of the upper wheel can be detected and indicated by rotating the sensor and adjustment can be made very quickly and precisely. Besides, since the piston is provided on the quill supporting the wheel and the cylinder chamber is formed in the inner sleeve corresponding thereto so as to produce pressure therein to remove the backlash in the mating portion between the screw portion of the quill and the worm wheel supported on the inner sleeve, the wheel may be adjusted axially accurately.

Figure 16:
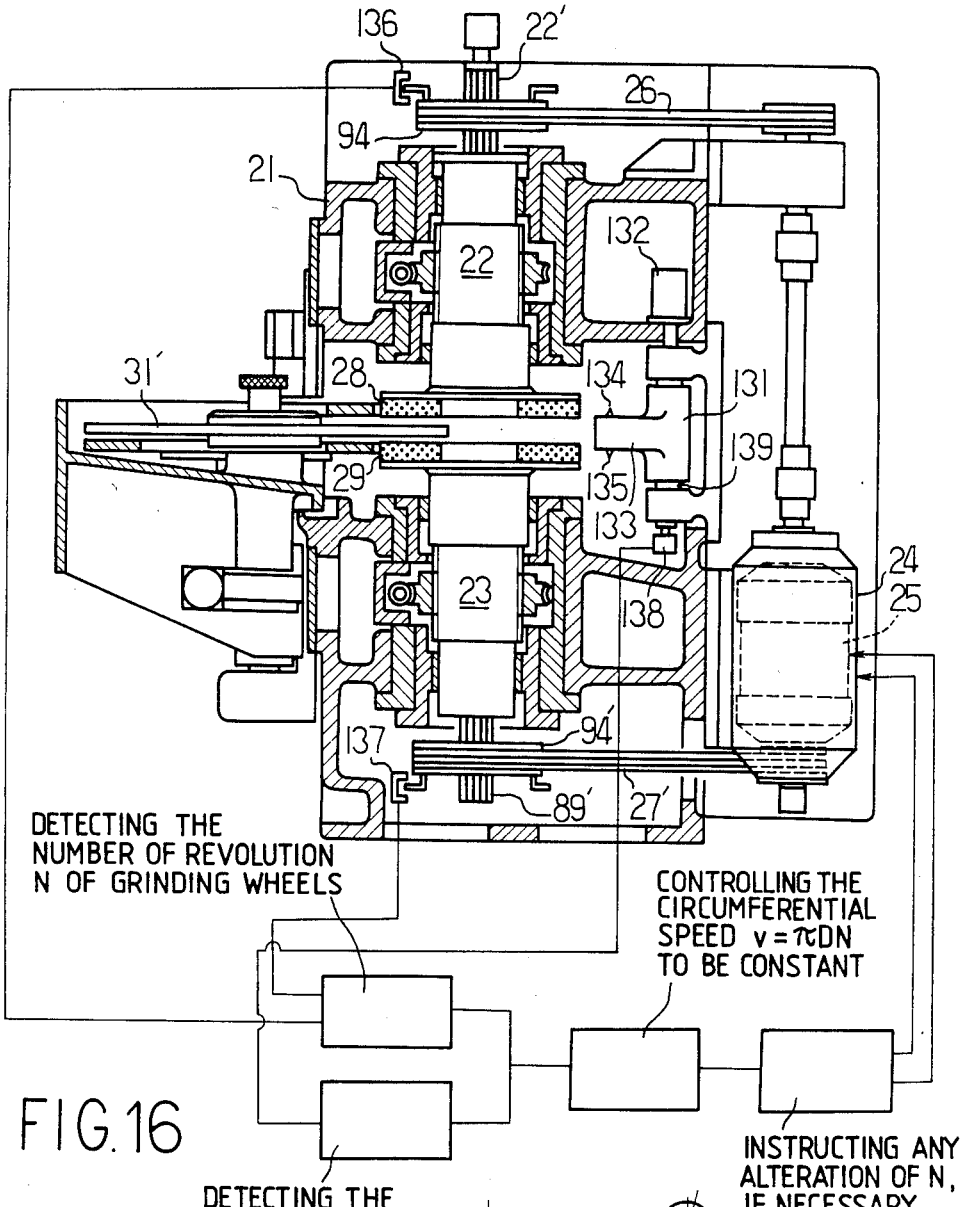
FIG. 16 is a vertical sectional view of a double-end surface grinding machine provided with a dresser.
Figure 17:
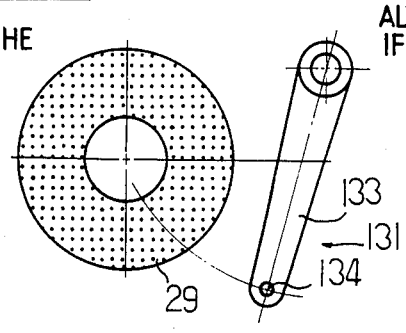
FIG. 17 is a plan view showing the relationship with a wheel dresser of FIG. 16.

FIG. 16 is a longitudinal sectional view of a double-end surface grinding machine mounted with a dresser of a further another embodiment of the present invention, in which on a main frame (21) a pair of sleeves (22) (23) are arranged coaxially vertically on the opposite sides, and supported movably vertically by a suitable driving mechanism (not shown) via a worm and the like, spindles (89)(89') driven rotationally respectively by wheel driven motors (24)(25) are supported freely rotationally in the sleeves (22) (23), on the corresponding shaft ends of the two spindles (88) (89) wheels (28) (29) are mounted respectively with its grinding surface opposing each other, in the middle of the two wheels (28)(29) a carrier plate (31') rotating in the plane normal to the wheel axis is disposed with its outer circumference being inserted between the two wheels (28)(29), and the work inserted therebetween by the carrier plate (31') is ground by the wheels (28) (29) simultaneously on both surfaces.

A dresser (131) is formed by projecting diamond tools (134)(135) on upper and lower tip portions of a dress arm (133) mounted on the frame (21) so as to be driven swingingly by a dress arm driving motor (132) in a plate normal to the wheel axis, by driving the dress arm (133) swingingly to insert the diamond tools (134) (135) between the rotating wheels (28)(29) and to move it in a radial direction of the wheels (28)(29), worn particles or stuffed chips on the grinding surface layers are shaved off and new particles are exposed on the grinding surfaces of the wheels (28)(29).

The numerals (136)(137) indicate wheel revolution sensors for detecting revolution of the wheels (28)(29) during dressing, for example, such as a rotary encorder and the like, which are mounted on the main frame (21), for example, in adjacent to pulleys (94)(95) disposed on the spindles (89)(89').

The numeral (138) denotes a dress arm position (angle) sensor for detecting the position (angle) of the dress arm (133) during dressing, for example, such as a resolver and the like, which is mounted, for example, on the lower end of a driving shaft (139) of the dress arm (133).

Now, the dressing operation in the construction mentioned above will be described. As the wheels (28) (29) are rotated by the wheel driving motors (24)(25), the dress arm (133) is driven swingingly by the dress arm during motor and the diamond tools (134) (135) are inserted between the wheels (28)(29) to start the dressing operation. At this time, as the dress arm (133) swings, its position (angle) is detected by the dress arm position (angle) sensor (138), thereby a dressing diameter D of the wheels (28)(29) is completed. Synchronizing therewith a circumferential speed V of the wheels (28)(29) at the position where the diamond tools (134)(135) are dressing is obtained by the wheel revolution sensors (138)(i37) from diameter D and revolution N of the wheels (28)(29). That is, the circumferential speed V can be obtained from the following equation;

$$V=\pi D N,$$

In the meantime, for performing uniform dressing thoroughly on the grinding surfaces of the wheels (28)(29) during the dressing operation, it is desirable to have a constant circumferential speed V. Thus, for obtaining the constant circumferential speed V, DN must be made constant, for this purpose as the diamond tools (134)(135) proceeds on the grinding surfaces of the wheels (28)(29) diametrically inwardly, revolution N of the wheels (28)(29) is computed from the dressing diameter D and the computed result is fed back to the wheel driving motor (24)(25) immediately.

According to this dresser, the dressing operation can be performed always at a constant circumferential speed V regardless of the circumferential speed difference of the inner and outer diameters of the wheels, so that the grinding surface of the wheels can be precisely dressed in the plane normal to the wheel axis and the grinding accuracy of the work can be improved.

What is claimed is:

1. A double-end surface grinding machine comprising a pair of opposing wheel heads mounted on a frame for feeding a work between the wheels to grind opposite sides of said work simultaneously by said two wheels, wherein one of the wheel heads requiring the tilt adjustment is constructed by a spindle rotating the wheel mounted at one end, a quill supporting the spindle freely rotationally, a sleeve holding said quill supported on the frame freely swivelably by a swivel construction, an adjusting mechanism for swivelling said sleeve freely relative to the frame to adjust its tilt optionally, a clamping mechanism for fixing said sleeve to the frame, a sensor provided on the sleeve rotationally for detecting the tilt of the wheel electrically, and an annular zero guide disposed on the opposite side of said sensor and mounted on the frame after centering, and means including a cylinder chamber defined by a piston on one end of said quill and on the inner portion of said sleeve for eliminating a backlash.

2. A double-end surface grinding machine:

a main frame;

a pair of coaxially opposing wheel heads mounted on said frame;

a pair of grinding wheels each mounted on one of said wheel heads for grinding opposite sides of a work simultaneously by said pair of wheels;

one of said wheel heads requiring tilt adjustment including a spindle rotating the wheel mounted at one end thereof, a quill freely rotationally supporting the spindle, a sleeve holding said quill and being freely swivelably supported on said frame, an adjusting mechanism for swivelling said sleeve freely relating to the frame to adjust its tilt optionally, a clamping mechanism for fixing said sleeve to the frame, a sensor provided on the sleeve rotationally for detecting the tilt of the wheel elecrically, an annular zero guide on the opposite side of said sensor and mounted on the frame after centering, and means including a cylinder chamber defined by a piston on one end of said quill and on the inner portion of said sleeve for eliminating backlash;

a carrier assembly including means for swinging a swivel arm holding a work to feed the work between the pair of wheels, means for rotating a work pocket gear holding the work by the swivel arm to give a rotating motion to the work, and means for reciprocating a block with the swivel arm to give on oscillating motion to the work; and a carrier frame having said carrier assembly mounted thereon, said frame being mounted on said main frame and rotatable about a point on or off the main frame in a plane normal to a wheel axis.

* * * * *

UNITED STATES PATENT AND TRADEMARK OFFICE

CERTIFICATE OF CORRECTION

PATENT NO. : 4,782,631
DATED : November 8, 1988
INVENTOR(S) : Nishio

It is certified that error appears in the above-indentified patent and that said Letters Patent is hereby corrected as shown below:

On the title page:

Title page, item [21], delete "11,909" and insert therefor -- 011,090 --.

Signed and Sealed this

Thirteenth Day of August, 1996

*Attest:*

*Attesting Officer*

BRUCE LEHMAN

*Commissioner of Patents and Trademarks*